US005578906A

United States Patent [19]

Smith

[11] Patent Number: 5,578,906

[45] Date of Patent: Nov. 26, 1996

[54] FIELD EMISSION DEVICE WITH TRANSIENT CURRENT SOURCE

[75] Inventor: Robert T. Smith, Tempe, Ariz.

[73] Assignee: Motorola, Schaumburg, Ill.

[21] Appl. No.: 416,120

[22] Filed: Apr. 3, 1995

[51] Int. Cl.[6] ..... G09G 3/10

[52] U.S. Cl. ..... 315/169.3; 315/169.1; 315/167; 315/174; 315/175

[58] Field of Search ..... 315/169.1, 169.3, 315/170, 167, 165, 163, 174, 175

[56] References Cited

U.S. PATENT DOCUMENTS

| | | | |
|---|---|---|---|
| 5,278,475 | 1/1994 | Juskie et al. | 315/169.1 |
| 5,300,862 | 4/1994 | Parker et al. | 315/169.1 |
| 5,313,140 | 5/1994 | Smith et al. | 315/169.1 |

*Primary Examiner*—Frank Gonzalez

*Assistant Examiner*—Reginald A. Ratliff

*Attorney, Agent, or Firm*—Gary F. Witting; Eugene A. Parsons

[57] ABSTRACT

A field emission device (100) having an electron emitter (101), for emitting electrons, an extraction electrode (102) proximally disposed with respect to the electron emitter (101), an anode (103) for collecting some of any emitted electrons is formed. Anode (103) is distally disposed with respect to the electron emitter (101). A transient current source (110) is operably coupled between the electron emitter (101) and a reference potential (107). Transient current source (110) provides a transient current to the electron emitter (101) to enhance response time for emission of electrons from the electron emitter (101) of the field emission device (100). A controlling input line (111) is provided for current controlling signals to the transient current source (110) with the controlling input line (111) being operably coupled to the transient current source (110).

17 Claims, 2 Drawing Sheets

FIELD EMISSION DEVICE WITH TRANSIENT CURRENT SOURCE

FIELD OF THE INVENTION

This invention relates, generally, to field emission devices and, more particularly, to field emission devices employed as image display devices.

BACKGROUND OF THE INVENTION

Currently, field emission devices (FEDs) have electron emitters which emit electrons into a vacuum region by means of an induced electric field near the surface of the electron emitter. The electric field in many instances is realized by providing an extraction electrode or gate electrode in close proximity to the electron emitter and applying a suitable potential therebetween. Emitted electrons are commonly, although not necessarily, collected by a distally disposed anode. However, in many instances, field emission devices are identified as electron emitters with only an associated extraction electrode. In the instances when field emission devices are employed as electron sources for display devices, it is desirable to effect a method to control electron emission to realize a preferred display image. For example, in order to provide an image on a viewing screen, electrons are emitted from some of a plurality of individually addressable field emission devices or some of an array of individually addressable field emission devices. However, currently, control of individual field emission devices is poor and inadequate, thereby not enabling adequate control of the field emission devices, thus effecting poor control of several parameters, such as brightness, turn on and turn off, and the like of each picture element or pixel.

It is known that by providing a select voltage between the extraction electrode and the electron emitter of the field emission device, that the electron emission from the electron emitter will be prescribed in accordance with an electric field induced at an emitting surface of the electron emitter. For a given voltage, a number of factors determine a magnitude of the induced electric field, thus the electron emission. A first factor is proximity of the extraction electrode to the electron emitter. The closer the extraction electrode is to the electron emitter for a given applied extraction voltage, the greater the magnitude of the induced electric field. A second factor that inversely relates the magnitude of the induced electric field is a radius of curvature of the electron emitting structure or electron emitter. Electron emitters formed as sharp tips, edges, or cones provide for high electric field enhancement near the emitting tip which includes a region of geometric discontinuity having a very small radius of curvature. Since these factors provide variation to each field emission device of any array of field emission devices, it is not practical to effect emission control by adjusting the extraction voltage or gate voltage between the gate electrode and the electron emitter. That is to say, the inventor has observed that the electron emissions from the electron emitters of any two field emission devices in an array of field emission devices are dissimilar because of fabrication variables. The inventor has also observed that methods currently used to compensate for these and other variations are complex and undesirable.

An alternative conventional technique employed in an attempt to effect electron emission control from field emission devices is to provide a controllable determined current source to the electron emitters of each field emission device of the array of field emission devices. By providing a controllable determined current source to each field emission device, it is not necessary to be concerned with fabrication variations because the voltage between the extraction electrode and the electron emitter will assume any required value (within the limits established by attendant voltage sources) to deliver the determined current.

However, conventional controllable determined current source techniques pose shortcomings that prevent a desired performance to be achieved. For example, each field emission device (FED) having an electron emitter has associated therewith a capacitance that must be charged each time the corresponding FED is required to emit electrons. Generally, the controlled current sources are required to provide dissimilar currents to each electron emitter of a plurality of FEDs in an array of FEDs in order to effect a gray scale capability for an image display. FEDs corresponding to pixel locations where the image display luminous intensity is desirably low will have imposed a requirement for a low electron emission and, therefore, a low determined current from the controlled determined current source associated therewith. The time required to charge the capacitance associated with the electron emitter of any FED is partially a function of the maximum available current into the capacitance. Thus, conventional controlled determined current sources that provide adequate current levels necessary for a desirable low FED emission levels do not provide adequate current necessary to charge the associated capacitance within an addressing time for that pixel.

Further, in applications employing controllable determinate current sources, the gray scale is effected by distinctly dissimilar current levels. Thus, the associated FED emitter capacitance must charge to a different level for each controlled determined current level. This is readily apparent when considering that the emission current density is a function of the voltage between the gate electrode and the electron emitter and that in order to provide a prescribed or determined current the voltage will assume a corresponding value. That is, a high current, corresponding to a high luminous level, will dictate a higher voltage than will a low current, corresponding to a low luminous level. This variation in the current available for emission and coincidentally charging of the associated capacitance provides intolerable difference in charging time of the various required electron emitter currents, and results in dissimilar electron emission characteristics at each electron emitter of the array of FEDs. Thus, providing variations that are intolerable and limit utility of this method of operation for image displays.

Accordingly, there exists a need for a method and a field emission device, and control circuitry which overcomes at least some of these shortcomings.

DETAILED DESCRIPTION OF THE DRAWINGS

Figure 1:
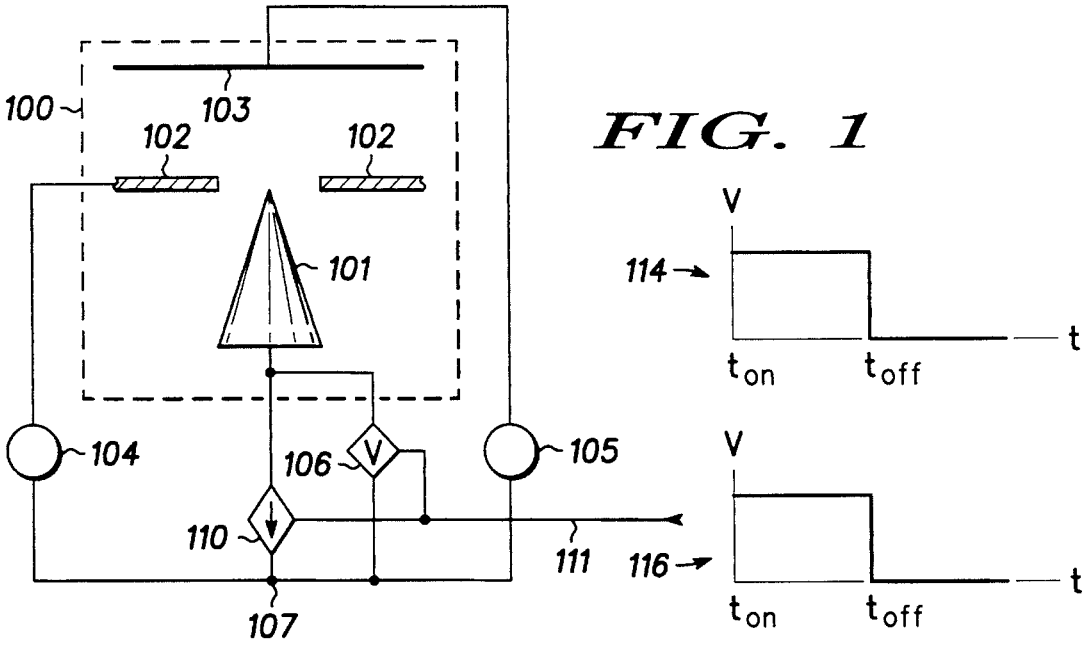
FIG. 1 is a schematic representation of a field emission device with operably coupled voltage sources and transient current source.

FIG. 1 is a schematic representation of a field emission device 100, represented by dashed line box, including an electron emitter 101, an extraction electrode or a gate electrode 102, an anode 103, transient current source 110, externally provided voltage sources 104 and 105, a reference potential 107, and dependent voltage source 106. In physical embodiments of field emission devices, extraction electrode 102 is proximally disposed with respect to electron emitter 101 and substantially symmetrically peripherally about a radius with respect to electron emitter 101. Anode 103 is distally disposed with respect to electron emitter 101 in which instance the schematic representation of FIG. 1 is further descriptive as a cross-sectional depiction.

Externally provided voltage sources 104 and 105 are depicted operably coupled between extraction electrode 102 and anode 103 and reference potential 107, respectively, with dependent voltage source 106 being depicted operably coupled between electron emitter 101 and reference potential 107. Additionally, dependent voltage source 106 is operably coupled and controlled by controlling input line 111, thereby enabling a control signal or signals in controlling input line 111 to control dependent voltage source 106 and transient current source 110 simultaneously. Generally, the control signal or signals externally provide current duration information or input signals, e.g., television signals, computer display signals, or the like.

For purposes of the present illustration and as practicable, operable connection of first and second externally provided voltage sources 104 and 105 and dependent voltage source 106 are depicted as being made to gate electrode 102 and anode 103, respectively, and emitter 101 and to reference potential 107 may in fact be referred to as being operably coupled to a reference potential, such as a ground reference, in which instance transient current source 110 would also be operably coupled to the reference potential.

Operation of a field emission device 100 is effected by providing a suitable voltage at extraction electrode 102 which is provided by the operably coupled first externally provided voltage source 104 and by providing a current of electrons from transient current source 110. For example, voltages between extraction electrode 102 and the reference potential can range from 5.0 volts to 200.0 volts. By virtue of voltage source 104 applied to extraction electrode 102, an electric field is induced at a surface of electron emitter 101 which gives rise to electron emission from electron emitter 101. When a suitable voltage is applied to anode 103 such as that which is applied by the operably coupled second voltage source 105 at least some emitted electrons are collected at anode 103. For example, voltages between anode 103 and the reference potential can range from 5.0 volts to 20,000.0 volts.

However, while emitted electron current or electron emission is conventionally varied by modulation of the voltage applied to extraction electrode, variations in physical realizations preclude this modulation as an effective method for controlling electron emission. Further, it should be realized that usage of conventional field emission devices in an array is further aggravated by inadequate reproducibility from one field emission device to another because of variations of manufacturing processes, thus necessitating the present invention.

Figure 2:
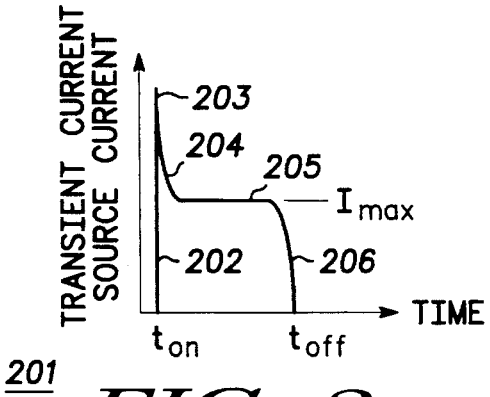
FIGS. 2–5 are graphical representations of time relationships versus transient current source current, anode current, dependent voltage output impedance, and control signal.
Figure 3:
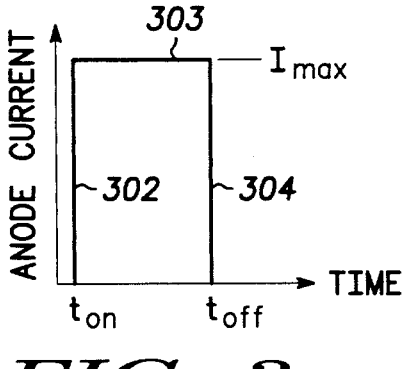
Figure 4:
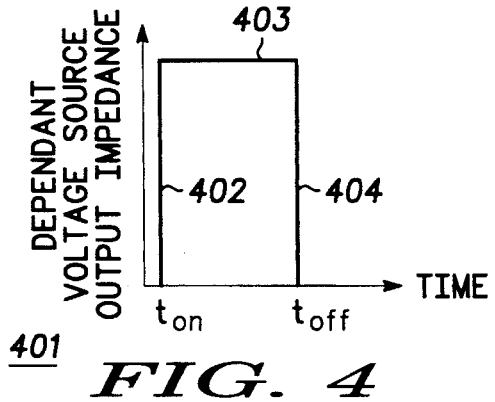

In the present invention, transient current source 110 is operably coupled between electron emitter 101 of field emission device 100 and reference potential 107. Transient current source 110 is a network of electronic elements that provides a short duration current pulse or a transient current to electron emitter 101, as shown in FIGS. 2–4. Additionally, transient current source 110, generally, has two adjustable current values and two adjustable time duration values. The first adjustable current value and the first adjustable time duration value correspond, in general, to portions 202, 203, and 204 of graph 201 (see FIG. 2). As can be seen in graph 201, the first adjustable current value is set at a high value ranging from 1E-4 to 1E-1 Amperes, with a preferred range from 1E-3 to 1E-2 Amperes, and a nominal value of 3E-3 Amperes, with the first time duration value ranging from 1E to 1E-4 seconds, with a preferred range from 1E-7 to 1E-5 seconds, with a nominal value of 1E-6 seconds. Thus, portions 202, 203, and 204 are generated.

The input signals carried by controlling input line 111 that operably control transient current source 110 can be either a voltage signal or a current signal. By way of example, as shown in voltage versus time plot 114, a voltage signal is illustrated that operably couples controlling input line 111 to transient current source 110, thus controlling transient current source 110. Alternatively, as shown in current versus time plot 116, a current is illustrated that provides current duration information to transient current source 110. It should be understood that in both the voltage and the current signals dependent voltage source 106 can also be operably coupled. Coupling the time duration information onto controlling input line 111 effectively places transient current source 110 in an ON mode to deliver an elevated current pulse to electron emitter 101 with a subsequent constant current that follows, as shown in FIGS. 2–5. Thus, the elevated current pulse allows a voltage between gate electrode 102 and electron emitter 101 to change rapidly to a voltage corresponding to a constant current value or an Imax value following the elevated current pulse. Electron emitter 101 then emits electrons more quickly than if only constant current, such as Imax, is used to start electron emission. Further, it should be understood that by providing the elevated current pulse capacitance associated with electron emitter 101 and other electrical elements in field emission device 100 is overcome, thus enabling an immediate emission of electrons, thus enabling an immediate current rise at anode.

FIGS. 2–5 are graphical representations of time relationships versus transient current source current, anode current, dependent voltage source output impedance, and a control signal or signals prescribed by an embodiment of the present invention. It should be understood that FIGS. 2–5 represent the same time, i.e., $t_{on}$ of FIGS. 2–5 correspond to the same time, likewise, $t_{off}$ of FIGS. 2–5 correspond to the same time.

FIG. 2 illustrates a graph 201 of time versus current source value. Generally, graph 201 can be segmented into several portions, such as portions 202–206. Portion 202 corresponds to when transient current source 110 initially provides current to electron emitter 101 at $T_o$, thereby emitting electrons from electron emitter 101. Current source value rapidly increases in portion 202 which depict a transient current portion of graph 201. During this time, the elevated current value quickly overcomes capacitance associated with electron emitter 101, thereby providing a sharp rise of current at anode 103. After transient current or portion 202 is completed, portion 204 illustrates a decline in current value to an Imax value at portion 205. Further, portions 203 and 205 illustrate the adjustable values of transient current source 110. For example, portion 203 illustrates a height or an amount of current received from transient current source 110, as well as a distance along time axis. Imax is a current value at which transient current source 110 holds the current at for an extended period of time until entering portion 206. Imax, generally, provides the current value at which the desired electron emission is held at. Portion 206 illustrates turning off the current, thus portion 206 illustrates a decline of current sent to emitter 101 at $t_{off}$ and field emitting device 100 is turned off.

FIG. 3 illustrates a graph 301 of time versus anode current measured at anode 103. Generally, graph 301 can be segmented into several portions, such as portions 302–304. It should be understood that Imax or a current maximum as shown in FIGS. 2 and 3 are essentially the same value.

Portion 302 rises sharply from $T_o$ to portion 303 with portion 303 being held constant for a period of time. Portion 304 illustrates a decline of anode current at Toff or when field emission device is turned off. As can be seen in FIG. 3, by providing a transient current represented by portion 203 of FIG. 2, anode current values form a square wave function, represented by portions 302, 303, 304. Further, as illustrated in FIG. 2., providing electron emitter 101 with threshold current 203, anode current, illustrated in FIG. 3, results in having portion 302 rise sharply to portion 303 that is held at Imax until portion 304 is reached. Thus, duration of portion 303 is more discretely controlled so as to effect a time modulation. It should be understood that by having portion 303 capable of being discretely turned on and off improved control of emitted electrons from electron emitter 101 is realized, thereby enabling modulation of field emission device 100 with time.

FIG. 4 illustrates a graph 401 of time versus output impedance for the dependent voltage source 106 and electron emitter 101. Generally, graph 401 can be segmented into several portions, such as portions 402–404.

As can be seen in FIG. 4, portion 402 rises sharply at time To to portion 403, thereby increasing a value of the output impedance. Portion 403 illustrates a constant value that ranges from 10E7 to 10E11 Ohms, with a preferred range from 1E8 to 1E10 Ohms, and a nominal value 1E9 Ohms. The constant value of output impedance from dependent voltage source 106 essentially disconnects dependent voltage source 106 from electron emitter 101 and transient current source 110, thereby eliminating any effect on the operation of transient current source 110 and electron emitter 101. Portion 404 illustrates a decline in impedance to a value when field emission device 100 is turned off. During operation of field emitter device 100, impedance from the dependent voltage source 106 regulates the rapidity of non-electron emission at Toff by discharging the capacitance of electron emitter 101, thus shortening the time for turning off of field emission device 100. Coupling transient current source 110 and dependent voltage source in parallel such that when transient current source 110 is ON dependent voltage source 106 is OFF and visa versa, enables anode current to be discretely pulsed as shown in FIG. 3. Thus, anode 103 can be modulated to control brightness.

Figure 5:
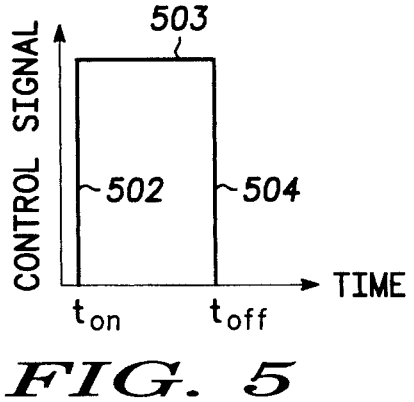

FIG. 5 illustrates a graph 501 of a control signal directed along control signal line 111 Generally, graph 501 can be segmented into several portions, such as portions 502–504.

As can be seen in FIG. 5, portion 502 rises sharply at time To to portion 503, thereby indicating a presence of the control signal on control line 111. Portion 503 is held at a constant level during electron emission from electron emitter 101, thus causing anode current to be held constant as shown by portion 303. By initialization of a control signal on control signal line 111, it can be seen that a number of events take place simultaneously. For example, initialization of the control signal on control line 111 to a high state operably couples transient current source 110 and dependent voltage source 106 such that when transient current source 110 is ON dependent voltage source 106 has a high output impedance and, therefore, has no effect on electron emitter 101 and transient current source 110. Alternatively, initialization of the control signal on control line 111 to a low state operably couples transient current source 110 and dependent voltage source 106 such that when transient current source 110 is OFF dependent voltage source 106 is in a low impedance state, thereby turning electron emitter 101 OFF. This enables improved control of anode current, i.e., portions 302 and 304 are vertical. Portion 504 of FIG. 5 illustrates a decline of control signal.

Figure 6:
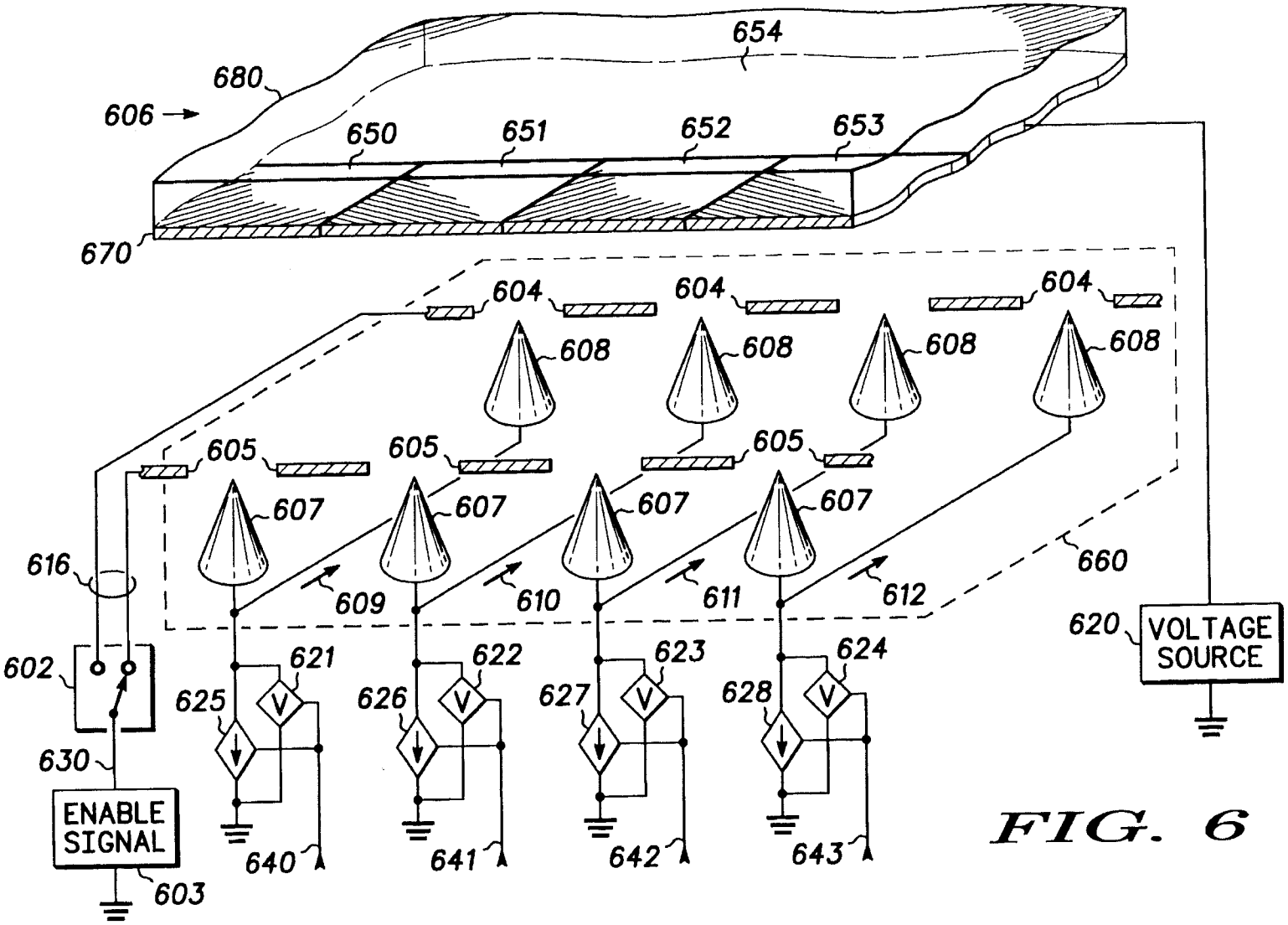
FIG. 6 is a schematic representation of an image display made with an embodiment of the present invention.

Referring now to FIG. 6, there is depicted a field emission device image display in accordance with the present invention. An array or a plurality of field emission devices, represented within a dashed line box labeled 660, each of which is provided for selectively energizing a portion of an anode 606 is shown. Proximally disposed extraction electrodes of each field emission device in the plurality of field emission devices 660 are interconnected in a manner which forms rows 604 and 605 of extraction electrodes of interconnected field emission devices 660. Electron emitters 607 and 608 of the plurality of field emission devices 660 are selectively interconnected in a manner which forms columns 609, 610, 611, and 612 that correspond to emitters 607 of interconnected field emission devices 660. A plurality of transient current sources 625, 626, 627, and 628 is operably connected between each respective one column of the plurality of columns 609, 610, 611, and 612 and a reference potential. A plurality of dependent voltage sources 621, 622, 623, and 624 is operably connected with each respective transient current source 625–628. Each of the plurality of rows 604 and 605 of extraction electrodes is operably coupled to an output of a plurality of outputs 616 of a switch 602 which is provided to selectively enable a row of the plurality of rows 604 and 605 of extraction electrodes by operably coupling to a selected row an enabling signal means 603 operably coupled between switch 602 input 630 and the reference potential. Each of the plurality of transient current sources 625, 626, 627, and 628 has operably connected thereto a controlling input line of a plurality of controlling input lines 640, 641, 642, and 643 whereon controlling signals are placed to selectively place the transient current source attached thereto in an ON mode. The duration of the ON mode of a transient current source is determined by the duration of the operably coupled controlling signal.

Electron emission takes place from field emission devices of the plurality of field emission devices 660 corresponding to the selected row of the plurality of rows 604 and 605 or extraction electrodes. Each field emission device within the selected row of array 660 emits a substantially identical electron current as that of each other field emission device of the selected row and as determined by each of the transient current sources. Effecting operation of the image display device in this manner eliminates performance variations which occur due to fabrication and materials inconsistencies. Emitted electrons are preferentially collected at distally disposed anode 606 which, for the image display now under consideration, includes at least a layer of cathodoluminescent material 670 disposed on a substantially transparent viewing screen 680. An externally provided voltage source 620 is operably connected between anode 606 and the reference potential to place an attractive voltage at anode 606 to facilitate collection of electrons.

Anode 606 includes a plurality of regions 650, 651, 652, 653, and 654. Regions 650, 651, 652, and 653 are associated with the field emission devices that are identified as operably interconnected via the interconnected extraction electrodes that comprise row or extraction electrodes 604, which is depicted as selected by the switching means 602 and operably coupled to the enabling signal means 603. Each of the field emission devices of selected row of extraction electrodes 604 emits a substantially similar electron current as determined by each attendant transient current source for a duration determined by the duration of the controlling signal input onto each respective controlling input line.

For example, the field emission device associated with selected row of extraction electrodes 605 and transient current source 625 emits electrons, corresponding to a preferred electron current determined by transient current source 625, for a duration during which transient current source 625 is in the ON mode as determined by the controlling signal coupled onto controlling input line 640. Emitted electrons are collected at anode 606 at region 650 that excites cathodoluminescent material 670 to a desired luminous intensity as depicted. The field emission device associated with row of extraction electrodes 605 and transient current source 626 will also emit electrons, corresponding to the preferred electron current determined by transient current source 626, for a duration during which transient current source 626 is in the ON mode as determined by the controlling signal coupled onto controlling input line 641. Field emission devices associated with row 605 and respective transient current sources 627 and 628 will similarly emit electrons corresponding to the preferred electron current and for a duration in accordance with the duration prescribed by the controlling signal applied to each controlling input line 642 and 643.

Luminous intensity of a region of the plurality of regions 650, 651, 652, and 653 of anode 606 is directly related to the duration of controlled excitation by emitted electrons since each of the transient current sources 625, 626, 627, and 628 provides substantially similar electron current to the associated field emission device to which it is operably connected. Further, region 650 provides greater luminous intensity than does region 651 and less luminous intensity than region 652 which is correlated to the duration of the controlling signal at each of the controlling input lines associated therewith. A controlling signal applied to controlling input line 640 which is of a longer duration than the controlling signal applied to controlling input line 641 and of shorter duration than the controlling signal applied to the controlling input line 642 produces a greater luminous intensity in region 650 then in region 651, and less luminous intensity in region 653 then in region 651.

Although FIG. 6 depicts that at each intersection of rows 604, 605 and columns 609, 610, 611, and 612 there is a single field emission device which will energize a corresponding region at anode 606 it should be understood that each anode picture element or pixel may be energized by a plurality of field emission devices in which instance the plurality of field emission devices is represented by the singular schematic depiction at each said intersection.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

By now it should be appreciated that a novel article and method for controlling field emission device have been provided. The method and the article provide for an enhanced response time of the field emission device. Also, a more discrete anode current is achievable with the present invention.

What is claimed is:

1. A field emission device comprising:

an electron emitter, for emitting electrons;

an extraction electrode proximally disposed with respect to the electron emitter;

an anode for collecting some of any emitted electrons, distally disposed with respect to the electron emitter;

a transient current source operably coupled between the electron emitter and a reference potential, the transient current source including an external current controlling terminal and providing a transient current to the electron emitter for enhancing response time for emission of electrons from the electron emitter of the field emission device in response to current controlling signals applied to the external current controlling terminal; and a controlling input line for providing current controlling signals to the transient current source, the controlling input line being operably coupled to the external current controlling terminal of the transient current source.

2. A field emission device as claimed in claim 1 further including suitable voltages operably coupled between the extraction electrode and the reference potential, between the anode and the reference potential, and between the controlling input line and the reference potential for placing the field emission device in an ON state.

3. A field emission device as claimed in claim 2 wherein the ON state of the field emission device is determined by a duration of a voltage operably coupled between the controlling input line and the transient current source.

4. A field emission device as claimed in claim 1 further including voltages operably coupled between the extraction electrode and the reference potential and between the anode and the reference potential, and current operably coupled between the controlling input line and the reference potential so as to place the field emission device in an ON state.

5. A field emission device as claimed in claim 4 wherein the ON state of the field emission device is determined by a duration of the current operably coupled between the controlling input line and the reference potential.

6. A field emission device as claimed in claim 1 wherein the anode, includes a substantially transparent viewing screen having at least a cathodoluminescent layer disposed thereon for collecting at least some of any emitted electronics and is distally disposed with respect to the electron emitter.

7. A field emission device as claimed in claim 6 further including voltages operably coupled between the extraction electrode and the reference potential, between the anode and the reference potential, and between the controlling input line and the reference potential so as to place the field emission device in an ON state.

8. A field emission device as claimed in claim 7 wherein the ON state of the field emission device is determined by a duration of a voltage operably coupled between the controlling input line and the transient current source.

9. A field emission device as claimed in claim 6 further including voltages operably coupled between the extraction electrode and the reference potential and between the anode and the reference potential, and current operably coupled between the controlling input line and the reference potential so as to place the field emission device in an ON state.

10. A field emission device as claimed in claim 9 wherein the ON state of the field emission device is determined by a duration of the current operably coupled between the controlling input line and the reference potential.

11. A field emission device image display comprised of:

a plurality of field emission devices each having an electron emitter for emitting electrons, a portion of an extraction electrode proximally disposed with respect to the electron emitter, an anode including a cathodoluminescent layer disposed thereon for collecting at least some of any emitted electrons, the anode being distally disposed with respect to the electron emitter;

a plurality of transient current sources each of which is operably coupled between at least an electron emitter and a reference potential for providing a determined source of electrons to be emitted by the electron emitter, and each transient current source including an external current controlling terminal for enhancing response time for emission of electrons from the electron emitter of the field emission device in response to current controlling signals applied to the external current controlling terminal; and a plurality of controlling input lines, for providing current controlling signals to the plurality of transient current sources, each operably coupled to the external current controlling terminal of one of the plurality of transient current sources.

12. A field emission device image display as claimed in claim 11 further including voltages operably coupled between the extraction electrode and the reference potential, between the reference potential, and between each controlling input line of the plurality of controlling input lines and the reference potential so as to place the field emission device in an ON state.

13. A field emission device image display claimed in claim 12 wherein the ON state of each of the field emission devices of the plurality of field emission devices is determined by a duration of the voltage operably coupled between and associated controlling input line of the plurality of controlling input lines and the reference potential.

14. A field emission device image display claimed in claim 11 further including voltages operably coupled between the extraction electrode and the reference potential and between the anode and the reference potential, and a current operably coupled between each controlling input line of the plurality of controlling input lines and the reference potential so as to place any number of the plurality of field emission devices in an ON state.

15. A field emission device image display as claimed in claim 14 wherein an ON state of any number of the plurality of field emission device is determined by a duration of a voltage operably coupled between an associated controlling input line of the plurality of controlling input lines and the transient current sources.

16. A field emission device image display as claimed in 11 wherein the anode includes a plurality of picture elements, each of the plurality of picture elements being selectivity energized by impinging electron being emitted by one of the plurality of field emission devices.

17. A field emission device comprising:

an electron emitter, for emitting electrons;

an extraction electrode proximally disposed with respect to the electron emitter;

an anode for collecting some of any emitted electrons, distally disposed with respect to the electron emitter;

a transient current source operably coupled between the electron emitter and a reference potential, the transient current source provides a transient current to the electron emitter for enhancing response time for emission of electrons from the electron emitter of the field emission device;

a controlling input line for providing current controlling signals to the transient current source, the controlling input line being operably coupled to the transient current source; and a dependent voltage source operably coupled between the electron emitter, and a reference potential, as well as being operably coupled to the controlling input line, thereby enabling the controlling input line to simultaneously control both the dependent voltage source and the electron emitter.

* * * * *